US009096062B2

(12) United States Patent
Casella et al.

(10) Patent No.: US 9,096,062 B2
(45) Date of Patent: Aug. 4, 2015

(54) MANUFACTURING PROCESS FOR AN INK JET PRINTHEAD INCLUDING A COVERLAY

(75) Inventors: James M. Casella, Webster, NY (US); Peter M. Gulvin, Webster, NY (US); Varun Sambhy, Penfield, NY (US); Kock-Yee Law, Penfield, NY (US); Hong Zhao, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 987 days.

(21) Appl. No.: 13/195,186

(22) Filed: Aug. 1, 2011

(65) Prior Publication Data

US 2013/0032051 A1 Feb. 7, 2013

(51) Int. Cl.
*B41J 2/16* (2006.01)
*B41J 2/14* (2006.01)

(52) U.S. Cl.
CPC ..... *B41J 2/162* (2013.01); *B41J 2/1433* (2013.01); *B41J 2/16* (2013.01); *B41J 2/1606* (2013.01); *B41J 2/1623* (2013.01); *B41J 2/1639* (2013.01); *Y10T 29/49126* (2015.01); *Y10T 29/49401* (2015.01)

(58) Field of Classification Search
CPC ..... B41J 2/1433; B41J 2/16; B41J 2/1606; B41J 2/162; B41J 2/1623; B41J 2/1639; Y10T 29/49126; Y10T 29/49401
See application file for complete search history.

(56) References Cited

U.S. PATENT DOCUMENTS

| | | | | |
|---|---|---|---|---|
| 7,266,868 | B2 * | 9/2007 | Sugahara | B41J 2/1623 |
| 8,540,346 | B2 * | 9/2013 | Dolan et al. | B41J 2/162 |
| 2008/0238997 | A1 * | 10/2008 | Nystrom et al. | B41J 2/1639 |
| 2012/0092416 | A1 * | 4/2012 | Platt et al. | B41J 2/162 |

FOREIGN PATENT DOCUMENTS

JP 2005047165 A * 2/2005

OTHER PUBLICATIONS

FREKOTE, TDS 55-NC™ Technical Data Sheet, Jan. 2010, 2 Pages.

* cited by examiner

*Primary Examiner* — A. Dexter Tugbang
(74) *Attorney, Agent, or Firm* — MH2 Technology Law Group LLP

(57) ABSTRACT

A method for forming an ink jet printhead can include interposing a coverlay between a press plate of a press and an ink jet printhead aperture plate assembly, such that the coverlay physically contacts an anti-wetting coating on a surface of the aperture plate assembly. With the coverlay contacting the anti-wetting coating, a force is applied to the aperture plate assembly using the press. The coverlay is separated from the aperture plate assembly, wherein the coverlay includes a layer having an elastic modulus of at least 0.5 GPa.

14 Claims, 4 Drawing Sheets

| COVERLAY TYPE | DIMPLING SEVERITY |
|---|---|
| PTFE (10 mil THICKNESS) | 20.5 μm |
| PTFE (1 mil THICKNESS) | ~ 6.0 μm |
| POLYIMIDE | < 0.6 μm |

MANUFACTURING PROCESS FOR AN INK JET PRINTHEAD INCLUDING A COVERLAY

CROSS-REFERENCE TO RELATED APPLICATION

This application is related to U.S. Ser. No. 13/095,610, titled "Patterned Metallization on Polyimide Aperture Plate for Laser-Ablated Nozzle," filed Apr. 27, 2011, and to U.S. Ser. No. 12/905,561, titled "Metallized Polyimide Aperture Plate and Method for Preparing Same," filed Oct. 15, 2010, the disclosures of which are incorporated herein by reference in their entireties.

FIELD OF THE EMBODIMENTS

The present teachings relate to the field of ink jet printing devices and, more particularly, to methods of making ink jet printheads and aperture plates for ink jet printheads and other devices.

BACKGROUND OF THE EMBODIMENTS

Fluid ink jet systems typically include one or more printheads having a plurality of ink jets from which drops of fluid are ejected toward a recording medium. The ink jets of a printhead receive ink from an ink supply chamber (manifold) in the printhead which, in turn, receives ink from a source such as an ink reservoir or an ink cartridge. Each ink jet includes a channel having one end in fluid communication with the ink supply manifold. The other end of the ink channel has an orifice or nozzle for ejecting drops of ink. The nozzles of the ink jets may be formed in an aperture plate that has openings corresponding to the nozzles of the ink jets. During operation, drop ejecting signals activate actuators to expel drops of fluid from the ink jet nozzles onto the recording medium. By selectively activating the actuators to eject ink drops as the recording medium and printhead assembly are moved relative to one another, the deposited drops can be precisely patterned to form particular text and/or graphic images on the recording medium.

Conventional ink jet printheads are constructed using stainless steel aperture plates with nozzles which are etched chemically or formed mechanically. Reducing cost and improving the performance of ink jet printheads is an ongoing goal of design engineers. A method of forming a printhead having improved performance and lower cost than conventional printheads would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of the present teachings can include a method for forming an ink jet print head, including interposing a coverlay between a press plate of a press and an ink jet printhead aperture plate assembly such that the coverlay physically contacts an anti-wetting coating on a surface of the ink jet printhead aperture plate assembly, wherein the ink jet printhead aperture plate assembly includes a polyimide: layer having a nozzle opening therethrough. With the coverlay contacting the anti-wetting coating, a force is applied to the ink jet printhead aperture plate assembly using the press for a duration of time. The ink jet printhead aperture plate is removed from the press, and the coverlay is separated from the ink jet printhead aperture plate. The coverlay can include a layer having an elastic modulus of at least 0.5 GPa.

Another embodiment of the present teachings can include an in-process ink jet printhead aperture plate assembly including a press plate of a press, an ink jet printhead aperture plate assembly comprising a polyimide layer having a nozzle opening therethrough, an anti-wetting coating on a surface of the polyimide layer, and a coverlay which physically contacts the anti-wetting coating and comprises an elastic modulus of at least 0.5 GPa.

Yet another embodiment of the present teachings can include a method for forming an oleophobic anti-wetting coating (AWC), including: coating a substrate with a reactant mixture comprising an isocyanate compound and a hydroxyl functionalized fluoro-crosslinking material, subjecting the coated reactant mixture to a first curing treatment at a first temperature, and subjecting the coated reactant mixture to a second curing treatment at a second temperature which is higher than the first temperature.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the present exemplary embodiments of the present teachings, examples of which are illustrated in the accompanying drawings. Wherever possible, the same reference numbers will be used throughout the drawings to refer to the same or like parts.

As used herein, the word "printer" encompasses any apparatus that performs a print outputting function for any purpose, such as a digital copier, bookmaking machine, facsimile machine, a multi-function machine, etc. The word "polymer" encompasses any one of a broad range of carbon-based compounds formed from long-chain molecules including thermoset polyimides, thermoplastics, resins, polycarbonates, and related compounds known to the art.

Conventional stainless steel aperture plates for ink jet printheads are suitable for their intended purpose, but are expensive to manufacture due to the required formation of apertures or nozzles using chemical or mechanical etch techniques. A polyimide aperture plate is less expensive to manufacture, for example because the nozzles can be laser etched, which reduces processing time and costs.

An ink jet printhead, a printer including the ink jet printhead, and methods of forming the ink jet printhead using a polyimide aperture plate is described in U.S. Ser. No. 12/905,561, titled "Metallized Polyimide Aperture Plate and Method for Preparing Same," filed Oct. 15, 2010. The ink jet printhead of this referenced application can include an aperture plate with a first layer (for example, polyimide) and a second layer (for example, aluminum). Furthermore, a low adhesion, ink phobic (i.e., oleophobic) coating can be applied to the aluminum layer so that ink can be more easily removed from the exterior of the aperture plate to provide an aperture plate with low adhesion such that ink can be more easily wiped off with a blade or through self-cleaning. The insertion of the aluminum layer between the polyimide substrate and the ink phobic layer can reduce energy waste and can help to enable printer compliance with ENERGY STAR® requirements.

Figure 1:
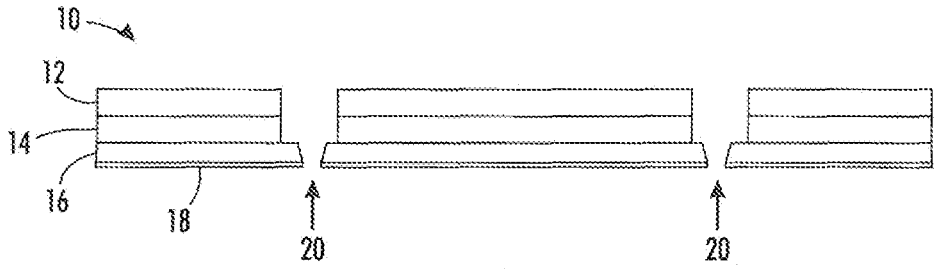
FIG. 1 is a magnified cross section of a portion of a print head aperture plate assembly.

FIG. 1 depicts a magnified cross section of a portion of an ink jet printhead aperture plate assembly 10. The FIG. 1 assembly 10 includes an aperture brace 12, an aperture plate adhesive 14, an aperture plate 16, and a low adhesion anti-wetting coating (AWC) 18 on the outer surface of the aperture plate 16. In an embodiment, the aperture brace 12 can be manufactured from a metal such as stainless steel having a thickness of between about 10 μm and about 50 μm. The aperture plate adhesive 14 can be manufactured from a thermoplastic polyimide film such as DuPont® ELJ-100, and can have a thickness of between about 10 μm and about 50 μm. The aperture plate 16 can be manufactured from a polyimide film such as Upilex® available from Ube Industries, and can have a thickness of between about 10 μm and about 50 μm. The AWC 18 can include a fluoropolyurethane (F-polyurethane) coating synthesized by crosslinking an isocyanate compound (for example, a diisocyanate or triisocyanate) with a functionalized fluoro crosslinking material, for example a dihydroxy-terminated perfluoropolyether such as Fluorolink® D, Fluorolink-E10H and the like from Solvay Advanced Polymers, LLC, and can be between about 0.5 μm and about 5.0 μm thick. The isocyanate compound can be, for example, diphenylmethane diisocyanate (MDI), toluene diisocyanate (TDI), helamethylene diisocyanate (HDI), isophorone diisocyanate (IPDI), hydrogenated MDI, tetra-methyl xylene diisocyanate, naphthalene diisocyanate, cyclohexylene diisocyanate, trimethylhexamethylene diisocyanate, bis(4-isocyanatocyclohexyl)methane, uretidione dimers of monomeric diisocyanates of one or more of HDI, IPDI, TDI and MDI, cyclotrimerized isocyanurates of monomeric diisocyanates of one or more of HDI, IPDI and TDI, suitable oligomers, polymers or copolymers containing isocyanate (—NCO) functional groups, and mixtures thereof.

Figure 2:
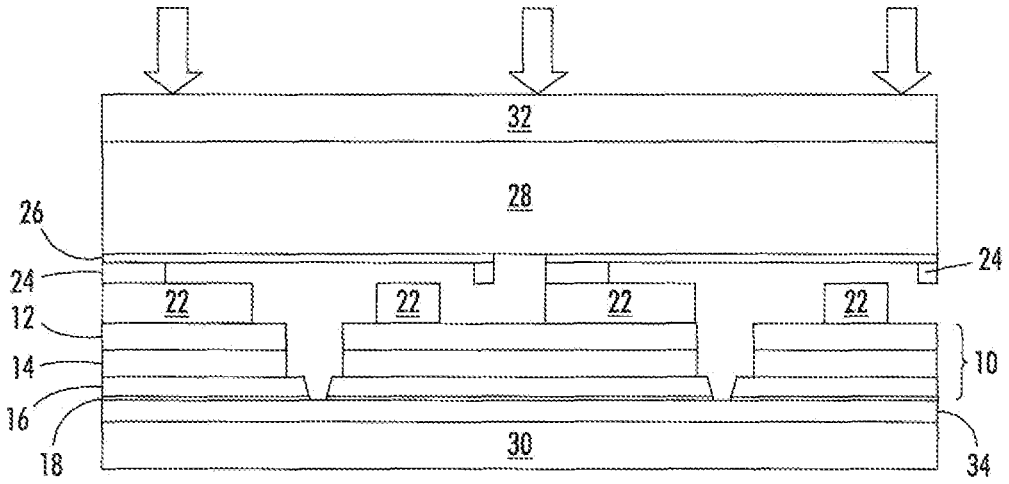
FIG. 2 is a cross section depicting an in-process ink jet printhead aperture plate-press assembly including the print head aperture plate assembly of FIG. 1 being attached to other printhead structures in a press during a jet stack press operation.

FIG. 2 is a cross section depicting an in-process ink jet printhead aperture plate-press assembly including the print head aperture plate assembly of FIG. 1 in the process of being attached to other printhead structures in a press during a jet stack press operation. FIG. 2 depicts the mounting of the aperture plate assembly 10 onto other printhead jet stack structures, such as an inlet/outlet plate 22, body plate 24, membrane or diaphragm 26, and other printhead structures 28 which are depicted in FIG. 2 in block form for simplicity of explanation. The other printhead structures 28 can include, for example, piezoelectric transducers, a printed circuit board, a manifold, etc. During the assembly of the aperture plate assembly 10 onto the body plate 22, the aperture plate assembly 10 and structures 22-28 are placed between a lower press plate 30 and an upper press plate 32 of a press and pressed together at elevated temperatures for a period of time to cure an adhesive (not individually depicted for simplicity) to assemble the printhead.

FIG. 2 also depicts a protective structure referred to as a "coverlay" 34. The coverlay 34 is located between the aperture plate assembly 10 and the lower press plate 30 which contacts the AWC 18 during the jet stack press operation. The coverlay can be any suitable material such as polytetrafluoroethylene (PTFE—DuPont® Teflon®), perfluoroalkoxy (PFA), or fluorinated ethylene propylene (FEP). The type of coverlay material use can depend on the press conditions (temperature and pressure). Material melting points are 335° C. for PTFE, 305° C. for PFA, and 260° C. for FEP. The coverlay 34, which can be about 1 mil thick, protects the front face of the aperture plate assembly 10 from damage during the high temperature, high pressure jet stack press operation.

Figure 3:
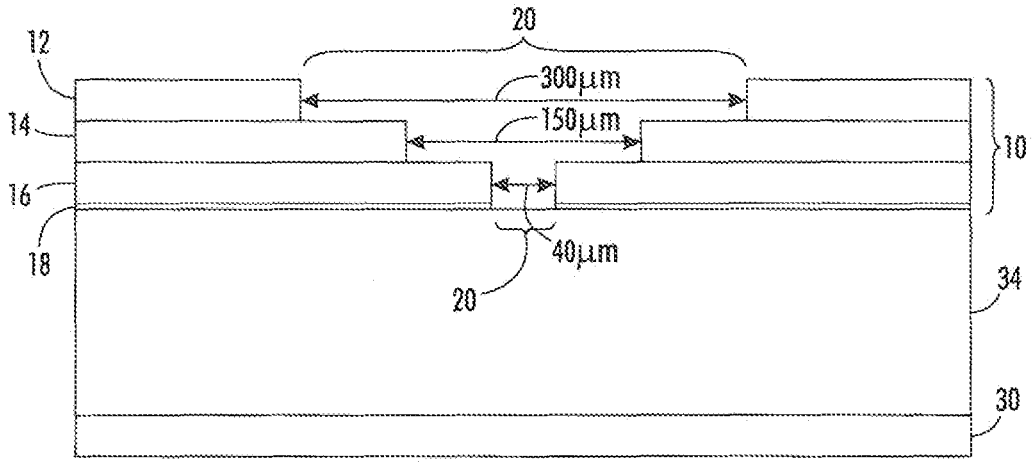
FIG. 3 is a magnified cross section of a nozzle area of an aperture plate assembly, a coverlay, and a bottom press plate.

In an embodiment of an aperture plate assembly including a polyimide layer, it has been found that the region around the nozzles 20 on the front face of the aperture plate assembly can dimple or deform upward (i.e., toward the body plate 22) as a result of several jet stack press operations. This deformation is permanent and can lead to misdirectional jetting of ink during printing and can result in a poor printed image quality. Without intending to be bound by theory, this deformation may occur at least in part as a result of the particular structure of the nozzle 20 of the aperture plate assembly 10 depicted in magnified cross section in FIG. 3. In this embodiment, the nozzle opening in the stainless steel aperture brace 12 is about 300 μm in diameter, the nozzle opening in the thermoplastic polyimide aperture plate adhesive 14 is about 150 μm in width (diameter, in a circular nozzle), and the nozzle openings in the polyimide aperture plate 16 and the AWC 18 are about 40 μm in width (diameter, in a circular nozzle). Thus the flexible polymer AWC 18, the flexible polyimide aperture plate 16, and the flexible aperture plate adhesive 14 are unsupported by the stainless steel aperture brace 12 toward the center of the nozzle 20. Because the structures 14, 16, 18 toward the center of the nozzles 20 are unsupported, they can collapse and deform during a jet stack press operation, for example because the PTFE coverlay flexes into the nozzle opening during the press operation.

The inventors have discovered that a more rigid (i.e., higher modulus) coverlay material produces better results than a PTFE coverlay. Without being bound by theory, it is thought that the higher modulus material does not flex into the nozzle opening as much when using a more rigid coverlay. A higher modulus material, however is more likely to damage the surface of the aperture plate assembly 10, for example through physical contact with the AWC. The AWC 18 is formed for at least two reasons. One is to maintain a high contact angle with ink on the surface of the aperture plate 16, thereby raising the drool pressure of the nozzles to reduce or eliminate spontaneous ink drooling and ink drooling after being wiped. The second is to maintain low adhesion of the ink to the surface, thereby facilitating cleaning and reducing or eliminating the buildup of ink drops and ink residues on the surface of the aperture plate during use. Damage to the AWC can result in decreased print quality. Thus the coverlay material should reduce deflection and dimpling of the nozzle area while sufficiently protecting the AWC during jet stack press operations.

Testing was performed to confirm the inventors' discovery that a more rigid coverlay material reduces deformation around the nozzle in an aperture plate assembly which includes one or more polyimide layers. Various coverlay materials were tested for their properties of reducing dimpling around the nozzle of the aperture plate assembly and preserving the AWC during the jet stack press operations. The materials tested had a higher elastic modulus than PTFE to reduce flexing of the coverlay into the nozzle, thereby reducing dimpling of the nozzle area. The elastic modulus of PTFE at room temperature is about 0.5 gigapascals (GPa), while FEP and PFA each have an elastic modulus at room temperature of about 0.6 GPa. As known in the art, the elastic modulus of a material will typically decrease at elevated temperatures.

Various coverlay base materials were tested and compared. Four of the base materials which were tested were: Type 1—a 1 mil thick PTFE layer as a baseline to compare with the other materials; Type 2—a 1 mil thick polyimide (elastic modulus=3 GPa) having a 1 μm thick coating of fluoropolyurethane (F-polyurethane) coating; Type 3—a 1 mil thick bare polyimide, and; Type 4—a 6 mil thick stainless steel (elastic modulus=180 GPa).

In addition, the coverlay materials were each tested both with and without an applied mold release coating on the surface of the coverlay which contacted the AWC. The mold release coating was a layer of Frekote® 55-NC™, available from Henkel Corporation of Rocky Hill, Conn. The mold release coating applied can be between about 60% and about 100% naphtha (petroleum), light alkylate having a thickness of about 10 μm. When coated, the coverlay base material provides a carrier layer for the release coating, such that the coverlay includes both the base material and the release coating.

To test the effect of each coverlay on the contact angle and sliding angle of an AWC, each of the eight samples described above was prepared, aligned with a coupon, and placed into a press. The coupon functioned as a substitute for the aperture plate assembly 10, and included a 1 mil thick layer of polyimide coated with a 1.0 μm to 2.0 μm thick layer of a fluoropolyurethane. The fluoropolyurethane coating functioned as the AWC 18. Each coupon and coverlay combination was placed into a stack press at a temperature of 290° C. and a pressure of 350 psi for 30 minutes to mimic a stack press process.

After performing the press process, the contact angle (CA) and sliding angle (SA) of each sample was tested. The CA test measured the angle at which a liquid ink met the AWC surface. The SA test is a measure of the mobility of the ink, indirectly measuring adhesion of the ink to the AWC, and is the minimum aperture plate assembly-angle at which a 10 μL drop of ink started to slide across the AWC.

In a separate test, microscope measurements of surface deflection were made on nozzle regions within a printhead face plate which were processed through the stack press using various coverlay materials. The deflection was determined by measuring how much the optical focus needed to be changed to focus the deflected regions.

Figure 4:
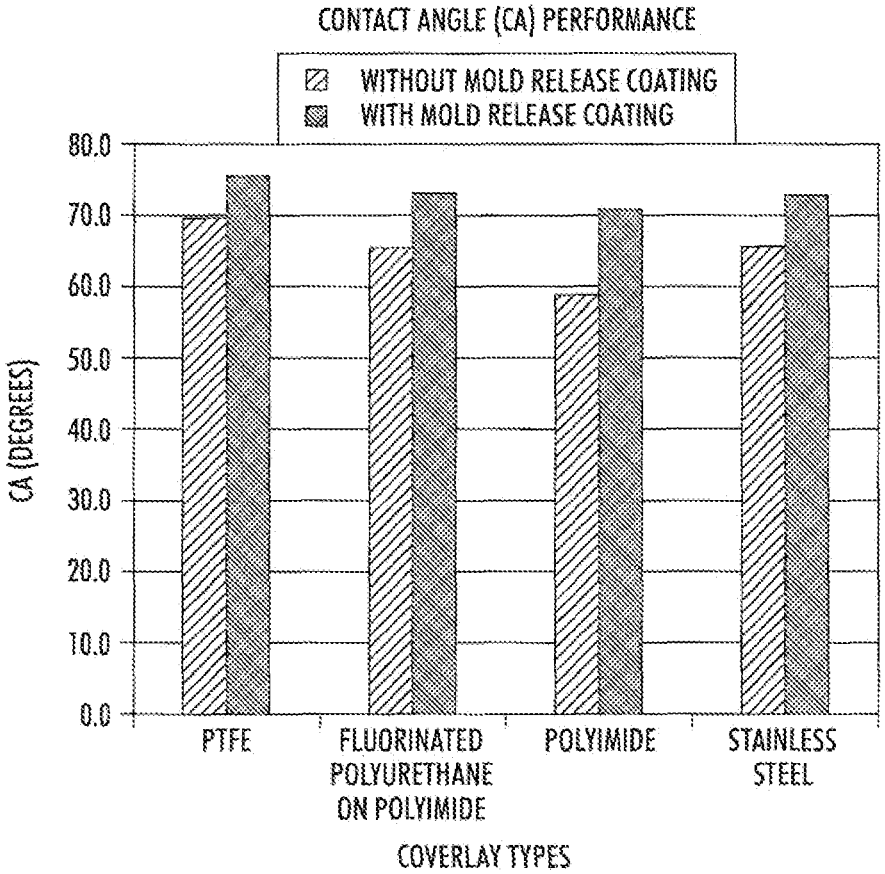
FIG. 4 is a graph of contact angles of an anti-wetting coating (AWC) produced using various coverlays.

FIG. 4 is a graph of AWC contact angle for the various coverlays subsequent to the jet stack press test process. As depicted, coverlays having a mold release coating produced improved contact angle results compared to the coverlays without a mold release coating. The baseline PTFE coverlay had a CA of about 69° without mold release, and about 75° with mold release. All of the other coverlays with a mold release coating had contact angles similar to that of PTFE, but the contact angle was less on coverlays without mold release. The lowest CA was 57° for the polyimide film without the mold release.

Figures 5, 6:
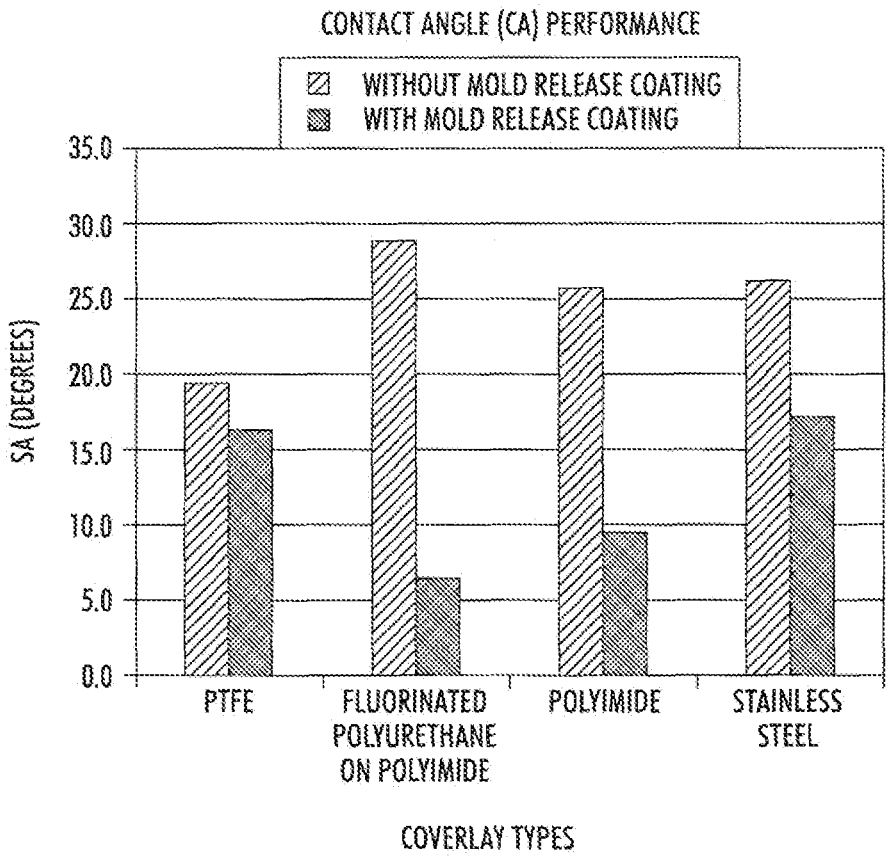
FIG. 5 is a graph of sliding angles of an AWC produced using various coverlays.
FIG. 6 is a table of dimpling severity of a nozzle area which results from the use of various coverlays.

FIG. 5 is a graph of AWC sliding angles for the various coverlays subsequent to the jet stack press test process. As depicted, coverlays having a mold release coating produced improved sliding angle results compared to the coverlays without a mold release coating. The baseline PTFE coverlay had an SA of about 19° without mold release, and about 16° with mold release. Stainless steel with a mold release had an SA similar to that of PTFE with mold release. The polyimide with the fluoropolyurethane coating and the polyimide without the fluoropolyurethane coating had SA's of 6° and 9° for the samples with mold release, which is better than the PTFE baseline.

The deflection measurements for various coverlay materials is depicted in the FIG. 6 table. The dimpling of a nozzle produced using a polyimide coverlay (<0.6 μm) is improved by a factor of 10 compared to a nozzle produced using a 1 mil thick PTFE coverlay (about 6.0 μm). For comparison, a nozzle produced using a 10 mil thick PTFE coverlay had a deflection of 20.5 μm.

In an embodiment of the present teachings, a build process for fabricating a high density piezoelectric printhead can include the use of a coverlay having an elastic modulus of at least about 0.5 GPa, or at least about 1 GPa, or at least about 0.3 GPa, for example at least about 5 GPa. The coverlay can include, for example, a polyimide film having a thickness of between about 5 μm and about 100 μm, or between about 5 μm and about 50 μm, or between about 5 μm and about 25 μm. The coverlay can include a polyimide film as a carrier coated with a low-adhesion, oleophobic coating, for example a fluoropolyurethane polymer or another polymer such that the coverlay has both an ink contact angle of at least 50°, or at least 55°, and a sliding angle using a test oil such as hexadecane of less than about 30°, or less than about 20°. In an embodiment, the coverlay can have a surface energy of less than about 15 dynes/cm, or less than about 12 dynes/cm, for example less than 10 dynes/cm.

In another embodiment, the coverlay can be coated with a release layer of naphtha (petroleum), light alkylate such as Frekote 55-NC or another polymer, to a thickness of between about 1 μm and about 30 μm, or about 2 μm and about 20 μm, or about 5 μm and about 10 μm. The coating can have the property of being minimally contaminating or non-contaminating to the AWC, such that a minimally transferring or non-transferring release of the AWC from the coverlay is provided. Along with the release performance, the release layer should be thermally stable at press temperatures to which it will be subjected, for example about 300° C.

In an embodiment, the coverlay can be used in a jet stack press and is interposed between a press plate, for example a lower press plate, and an aperture plate of an ink jet printhead. The aperture plate can include a polyimide layer coated with a low-adhesion, oleophobic coating such as a fluoropolyurethane or another polymer having both an ink contact angle of at least 50°, or at least 55°, and a sliding angle using a test oil such as hexadecane of less than about 30°, or less than about 20°. In an embodiment, the coverlay can have a surface energy of less than about 15 dynes/cm, or less than about 12 dynes/cm, for example less than 10 dynes/cm. The oleophobic anti-wetting coating (AWC) can be formed by coating a substrate with a reactant mixture comprising an isocyanate compound and a hydroxyl functionalized fluoro-crosslinking material. The coated reactant mixture can be subjected to a first curing treatment at a temperature of between about 130° C. and about 165° C., then to a second curing treatment at a temperature which is higher than the first curing treatment, for example between about 240° C. and about 300° C.

In an embodiment, the coverlay and the jet stack aperture plate assembly are placed between a lower press plate and an upper press plate of a press. The aperture plate can be part of a printhead jet stack. The coverlay, for example the coverlay coated on at least one side with a release layer, is interposed between one of the press plates and the aperture plate assembly. The release layer on the surface of the coverlay can contact an anti-wetting coating of the aperture plate assembly. A pressure of about 350 psi and a temperature of about 290° C. can be applied to the jet stack by the press. Pressure and temperature can be maintained for about 30 minutes.

The methods described above can be used to form a jet stack for an ink jet printer. In an embodiment, the jet stack can be used as part of an ink jet print head such as that depicted in FIG. 3.

Figure 7:
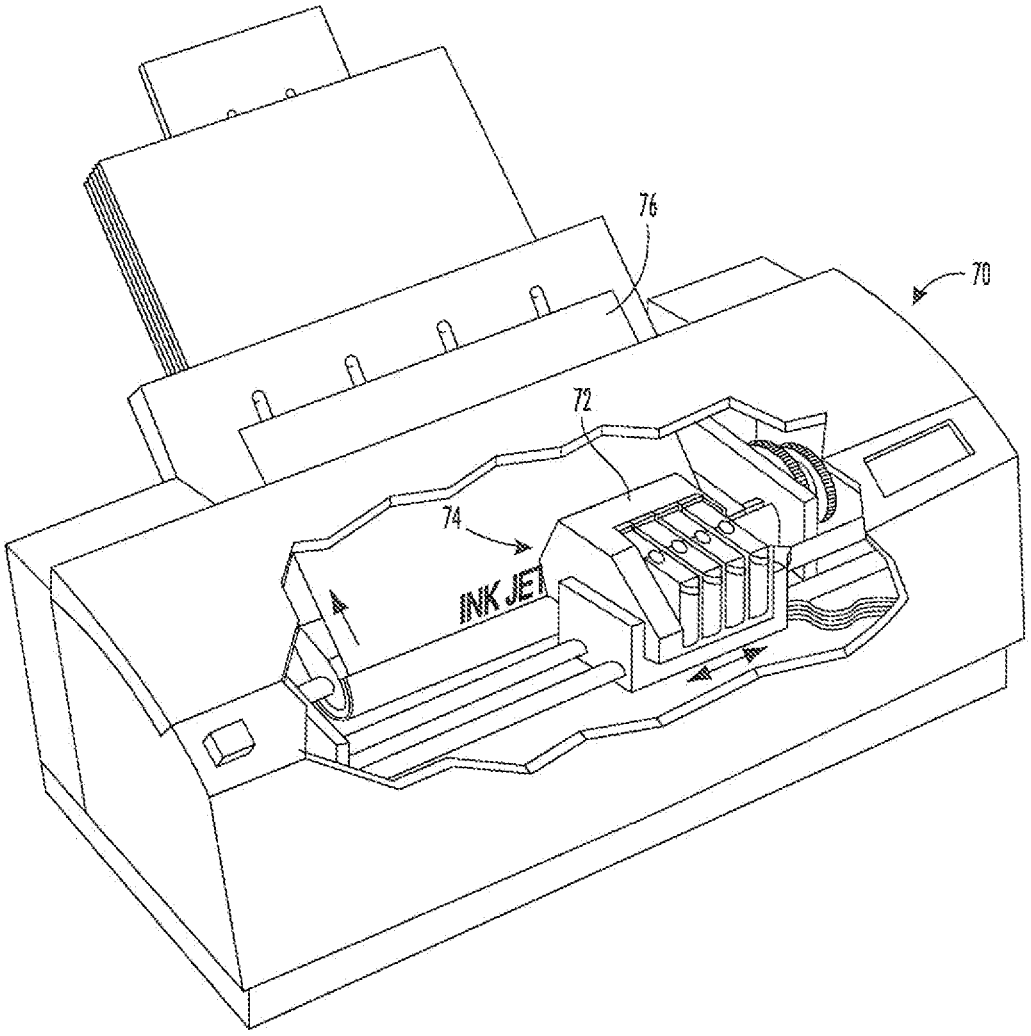
FIG. 7 depicts a printer and printer structures which can be formed using an embodiment of the present teachings.

FIG. 7 depicts a printer 70 including one or more ink jet print heads 72 and ink 74 being ejected from one or more nozzles 20 (FIG. 1) in accordance with an embodiment of the present teachings. The print head 72 is operated in accordance with digital instructions to create a desired image on a print medium 76 such as a paper sheet, plastic, etc. The print head 72 may move back and forth relative to the print medium 76 in a scanning motion to generate the printed image swath by swath. Alternately, the print head 72 may be held fixed and the print medium 76 moved relative to it, creating an image as wide as the print head 72 in a single pass. The print head 72 can be narrower than, or as wide as, the print medium 76.

Notwithstanding that the numerical ranges and parameters setting forth the broad scope of the present teachings are approximations, the numerical values set forth in the specific examples are reported as precisely as possible. Any numerical value, however, inherently contains certain errors, necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a wafer or substrate, regardless of the orientation of the wafer or substrate. The term "horizontal" or "lateral" as used in this application is defined as a plane parallel to the conventional plane or working surface of a wafer or substrate, regardless of the orientation of the wafer or substrate. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the wafer or substrate, regardless of the orientation of the wafer or substrate.

The invention claimed is:

1. A method for forming an ink jet print head, comprising:

interposing a coverlay between a press plate of a press and an ink jet printhead aperture plate assembly such that the coverlay physically contacts an anti-wetting coating on a surface of the ink jet printhead aperture plate assembly, wherein the ink jet printhead aperture plate assembly comprises a polyimide layer having a nozzle opening therethrough;

with the coverlay contacting the anti-wetting coating, applying a force to the ink jet printhead aperture plate assembly using the press for a duration of time;

removing the ink jet printhead aperture plate assembly from the press; and separating the coverlay from the ink jet printhead aperture plate assembly, wherein the coverlay comprises a layer having an elastic modulus of at least 0.5 GPa.

2. The method of claim 1, further comprising:

forming the coverlay by applying a mold release coating to a carrier layer; and contacting the mold release coating with the anti-wetting coating.

3. The method of claim 2, wherein the application of the release coating further comprises applying about 60% to about 100% naphtha (petroleum), light alkylate to a thickness of between about 0.5 μm and about 20 μm.

4. The method of claim 2, wherein forming the coverlay further comprises applying the mold release coating to the carrier layer comprising a material selected from the group consisting of polyimide and stainless steel.

5. The method of claim 2, wherein forming the coverlay further comprises applying the mold release coating to the carrier layer comprising a polyimide film coated with an oleophobic coating.

6. The method of claim 1, further comprising forming the ink jet printhead aperture plate assembly using a method comprising:

attaching a stainless steel aperture brace to a the polyimide layer of the aperture plate assembly using an aperture plate adhesive; and coating the polyimide layer with an anti-wetting coating.

7. The method of claim 6, wherein coating the polyimide layer with the anti-wetting coating comprises coating the polyimide layer with a fluoropolyurethane polymer synthesized by crosslinking an isocyanate compound with a functionalized fluoro crosslinking material.

8. The method of claim 7, wherein the isocyanate compound is a material selected from the group consisting of: diphenylmethane diisocyanate (MDI), toluene diisocyanate (TDI), hexamethylene diisocyanate (HDI), isophorone diisocyanate (IPDI), hydrogenated MDI, tetra-methyl xylene diisocyanate, naphthalene diisocyanate, cyclohexylene diisocyanate, trimethylhexamethylene diisocyanate, bis(4-isocyanatocyclohexyl) methane, uretidione dimers of monomeric diisocyanates of one or more of HDI, IPDI, TDI and MDI, cyclotrimerized isocyanurates of monomeric diisocyanates of one or more of HDI, IPDI and TDI, suitable oligomers, polymers containing isocyanate (—NCO) functional groups, copolymers containing isocyanate (—NCO) functional groups, and mixtures thereof.

9. The method of claim 7, wherein the functionalized fluoro crosslinking material is a dihydroxy-terminated perfluoropolyether.

10. The method of claim 6, wherein attaching the stainless steel aperture brace to the polyimide layer of the aperture plate assembly using the aperture plate adhesive further comprises:

attaching the stainless steel aperture brace having a nozzle opening therethrough with a diameter of about 300 μm to an aperture plate having the nozzle opening therethrough with a diameter of about 40 μm with the aperture plate adhesive having a nozzle opening therethrough with a diameter of about 150 μm.

11. The method of claim 1, further comprising interposing the coverlay between the press plate of the press and the ink jet printhead aperture plate, wherein the coverlay comprises the layer having an elastic modulus of at least 1.0 GPa.

12. The method of claim 1, further comprising forming the coverlay using a method comprising applying a polymer coating to a carrier, wherein the coverlay has an ink contact angle of at least 50° and an ink sliding angle of less than about 30°.

13. The method of claim 1, further comprising interposing the coverlay between the press plate of the press and the ink jet printhead aperture plate, wherein the coverlay comprises the layer having an elastic modulus of at least 3.0 GPa.

14. The method of claim 1, further comprising interposing the coverlay between the press plate of the press and the ink jet printhead aperture plate, wherein the coverlay comprises the layer having an elastic modulus of at least 5.0 GPa.

* * * * *